US005212424A

United States Patent [19]

Russell et al.

[11] Patent Number: 5,212,424

[45] Date of Patent: May 18, 1993

[54] METAL HALIDE DISCHARGE LAMP CONTAINING A SODIUM GETTER

[75] Inventors: Timothy D. Russell, Cleveland Heights; Raymond A. Heindl, Euclid, both of Ohio

[73] Assignee: General Electric Company, Schenectady, N.Y.

[21] Appl. No.: 795,439

[22] Filed: Nov. 21, 1991

[51] Int. Cl.[5] ..... H01J 61/20; H01J 61/26

[52] U.S. Cl. ..... 313/562; 313/639; 313/642

[58] Field of Search ..... 313/638, 639, 642, 562

[56] References Cited

U.S. PATENT DOCUMENTS 3,398,312 8/1968 Edris et al. .
3,832,591 8/1974 Larson .
4,360,756 11/1982 Spencer et al. .
4,798,995 1/1989 Gilliard et al. .
4,866,342 9/1989 Ramaiah et al. ..... 313/639

FOREIGN PATENT DOCUMENTS 49384 12/1972 Japan ..... 313/638

*Primary Examiner*—Palmer C. DeMeo
*Attorney, Agent, or Firm*—Edward M. Corcoran; Stanley C. Corwin

[57] ABSTRACT

Sodium metal has been found to be effective in gettering excess halogen present in metal halide lamps containing mercury, an inert starting gas and at least one ionizable metal halide for forming a light-emitting arc.

11 Claims, 2 Drawing Sheets

METAL HALIDE DISCHARGE LAMP CONTAINING A SODIUM GETTER

BACKGROUND OF THE INVENTION

1. Field of the Invention

This invention relates to a metal halide discharge lamp containing sodium to getter halogen. More particularly, this invention relates to a high intensity metal halide discharge lamp containing at least one ionizable metal halide, such as an iodide, and sodium metal to getter the excess halogen.

2. Background of the Disclosure

High intensity metal halide arc discharge lamps are well known to those skilled in the art, dating back to 1966 when Reiling added halides of various light-emitting metals to a high pressure mercury lamp to improve the color and efficacy of the lamp as is disclosed in U.S. Pat. No. 3,234,421. Since then metal halide lamps have become commercially useful for general illumination. Light-emitting metals favored by Reiling were sodium, thallium and indium in the form of iodides. This combination had the advantage of giving a lamp starting voltage almost as low as that of a mercury vapor lamp, thus permitting interchangeability of metal halide with mercury lamps in the same sockets. A later U.S. Pat. No. 3,407,327 to Koury et al issued in 1968, proposed as additive metals sodium, scandium and thorium which produces light of better quality, but requires a higher starting voltage so that the lamp is not generally interchangeable with mercury vapor lamps. Combinations of halogens such as sodium and scandium iodides with or without thallium iodide are still widely used and preferred for general illumination metal halide lamps. Unfortunately, sodium and scandium iodides are hygroscopic which results in introducing moisture into the lamp arc tube or arc chamber during the manufacturing process. This results in the formation of mercury iodide which causes hard starting requiring higher starting and operating voltages and also poorer lumen maintenance. In one manufacturing process, the lamps are dosed with mercury as liquid and with the iodides of Na, Sc and Th in pellet form. In this process, it is practically unavoidable that some hydrolysis reaction occurs due to absorption of moisture from the atmosphere by the pellets in transferring them to the lamp envelope. The metal halide dose comprising NaI, $ScI_3$ and $ThI_4$ is extremely hygroscopic and even very low levels of moisture will result in some hydrolysis. The hydrolysis results in conversion of metal halide to oxide with release of HI, for example:

$$2ScI_3+3H_2O \rightarrow Sc_2O_3+6HI$$

The HI reacts with mercury to form $HgI_2$ which is relatively unstable at high temperatures, and when the lamp warms up, the $HgI_2$ decomposes and releases free iodine. This all occurs in a short period of time, usually within the first few hours of lamp operation. Some excess iodine or other halogen is also frequently found in the dosing materials, possibly as a by-product of the synthesis of these materials. The result is a lamp which frequently contains excess iodine from the start.

To overcome this problem of free iodine formation, prior art lamps generally contain a metal to getter the excess iodine and/or other halogen, along with other impurities such as water, oxygen and nitrogen. Such metals have included cadmium, scandium, thallium, zinc and thorium. However, scandium and thorium are expensive and difficult to control as to the proper amount, because they don't readily form an amalgam with mercury and must therefore be introduced into the arc chamber as pieces of metal. Thorium is also radioactive. Zinc, cadmium and thallium are undesirable because they result in the formation of volatile halides which produce higher halogen partial pressures in the arc than would be present if scandium or thorium had been used as the getter. The higher halogen partial pressure can result in more rapid tungsten transport from the electrodes to the arc chamber wall with concomitant wall blackening and lumen loss. Thus, there is still a need for a more effective getter in such lamps.

SUMMARY OF THE INVENTION

The present invention relates to the discovery that sodium is an effective getter for excess halogen in metal halide lamps. The sodium can be introduced into the arc chamber in a facile manner as an amalgam with mercury either as a solid or liquid. Introducing the sodium into lamps in the form of a liquid sodium-mercury amalgam greatly facilitates handling and dose control. The use of sodium as a getter has been found to be particularly effective for metal halide lamps that contain metal iodide species. A sodium getter is especially advantageous for use with lamps that already contain a sodium halide, because no new or additional metal species is introduced into the arc chamber to alter the color of the light emitted by the arc. Thus the present invention relates to a metal halide arc discharge lamp comprising a hermetically sealed, light-transmissive arc tube or chamber containing within a pair of spaced apart electrodes, inert starting gas, mercury, at least one ionizable metal halide compound and sodium, wherein said sodium is present in an amount sufficient to getter any excess halogen and other impurities initially present in the lamp. By excess halogen is meant unreacted halogen inadvertently or deliberately introduced into the arc chamber during manufacture and halogen that is released in the arc chamber during the initial operation of the lamp as a result of chemical reactions of the metal halide present in the arc chamber as part of the fill. By initially present is meant halogen and impurities present in the arc chamber before the lamp is energized as well as those released in the arc chamber during the first hours of lamp operation. By other impurities is meant water, oxygen and nitrogen.

DETAILED DESCRIPTION

Figure 1:
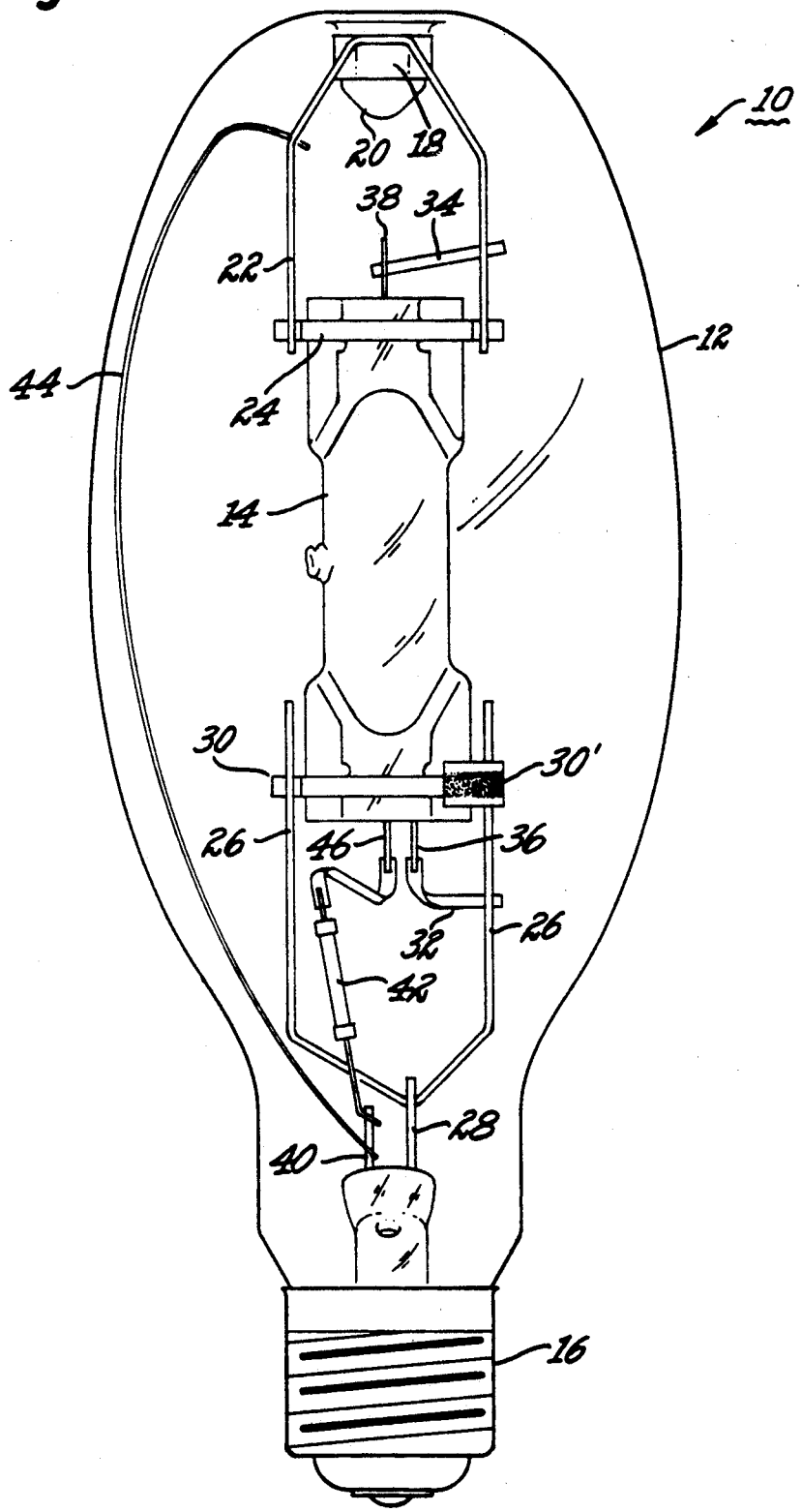
FIG. 1 is a schematic illustration of a metal halide arc discharge lamp in accordance with the invention.

As set forth above, the present invention relates to the discovery that sodium is effective for gettering excess halogen in metal halide lamps. In one embodiment of the invention the sodium will be introduced into the arc chamber of the lamp in the form of an amalgam of mercury and sodium, and more preferably a liquid amalgam of sodium and mercury, due to the greater ease and precision in dispensing minor amounts of liquid into the arc chamber as opposed to solid chunks or lumps of metal. While it is always possible to introduce the sodium as sodium metal, this is not practical due to sodium's well known reactivity with oxygen and water. In general, the amount of sodium metal amalgamated with mercury which is introduced into the lamp as an amalgam of sodium and mercury will range from about 1 to 5 mole % of the mercury-sodium amalgam in the case of a liquid amalgam. Enough sodium should be added to getter the excess halogen and other impurities such as water, oxygen and nitrogen initially present in the lamp and this must be determined on an experimental basis. Sodium present in an amount greater than that required to getter the excess halogen and other impurities initially present in the arc chamber or tube will react with the silica wall of the chamber (in the case of an arc chamber or tube made of fused quartz) to release silicon metal which is eventually transported to the electrode. If a sufficient amount of silicon is transported, electrode failure and concomitant shortened lamp life can result. The following is an illustrative, but non-limiting example of some of the chemistry involved.

During manufacturing, arc tubes of metal halide lamps are dosed with Hg and metal halides such as NaI, $ScI_3$, and $ThI_4$ which invariably contain various impurities such as $O_2$ and $H_2O$, producing $HgI_2$ according to the following overall reactions:

$$2ScI_3+3H_2O+2SiO_2+3Hg=Sc_2Si_2O_7+3HgI_2+3H_2 \quad (1)$$

$$4ScI_3+3O_2+4SiO_2+6Hg=2Sc_2Si_2O_7+6HgI_2 \quad (2)$$

(The individual steps of the above reactions may involve the formation of $Sc_2O_3$ and ScOI). Analogous reactions between $ThI_4$ and $O_2$ and $H_2O$ producing $HgI_2$ are also believed to occur. These reactions all occur within the first 24 hours and generally within the first few hours of lamp operation. As set forth above, the presence of $HgI_2$ is detrimental to the starting, operation and maintenance of the lamp.

The addition of sodium to the arc tube is believed to result in the following illustrative, overall reactions:

$$2Na+HgI_2=2NaI+Hg \quad (3)$$

$$12Na+4ScI_3+7SiO_2=12NaI+2Sc_2Si_2O_7+3Si \quad (4)$$

In reaction (3), sodium getters the iodine from $HgI_2$ and forms NaI which dissolves in the molten iodide dose. In reaction (4) which indicates what can happen if too much sodium is present, the sodium reacts with $ScI_3$ and the silica wall of the arc tube again producing NaI, along with the undesirable Si. Reaction (3) occurs very quickly (minutes), while reaction (4) occurs more slowly, but still within the initial hours of lamp operation.

In addition to metallic sodium and mercury, the arc chamber or tube will also contain a fill comprising an inert starting gas and a halide of one or more metals such as sodium, scandium, cesium, calcium, cadmium, barium, mercury, gallium, indium, thulium, holmium, thallium, dysprosium, germanium, thorium, selenium, tellurium, etc. Commonly used halides include iodides, bromides, chlorides, and mixtures thereof with bromides and chlorides being somewhat favored in some lamp designs and iodides being favored in others. Generally at least one iodide species will be found in the fill of most metal halide lamps. The starting gas will preferably be a noble gas and more preferably a noble gas selected from the group consisting essentially of krypton, argon, xenon and mixtures thereof.

Referring now to FIG. 1, which is a schematic view of an illustrative, but non-limiting embodiment of a metal halide lamp useful in the practice of the present invention, lamp 10 includes an outer envelope 12, made of a light-transmissive vitreous material, such as glass, a hermetically sealed, light-transmissive arc tube 14 made of a high temperature, light-transmissive, vitreous material such as fused quartz and a base 16 having suitable electrical contacts for making electrical connection to the arc tube. Arc tube or chamber 14 contains a pair of spaced apart electrodes within, one at each end, and a fill comprising noble gas, at least one ionizable metal halide, mercury and a getter. In lamps of the invention the getter is sodium metal. Arc chamber 14 is held in place within envelope 12 by frame parts comprising, at one end of the arc tube, a spring clip metal band 18 surrounding a dimple 20 in the envelope to which is attached by spot welding support member 22 which is also spot welded to strap member 24 which is mechanically fastened about the pinch seal region of arc tube 14. The other end of the arc tube is secured by support member 26 which is spot welded at one end to electrically conductive terminal 28 and welded at the other end to strap member 30 which is mechanically fastened about the other pinch seal region of the arc tube. Conductive members 32 and 34 are spot welded at one end to support members 26 and 22, respectively, and at the other end to inleads 36 and 38, respectively, of the respective arc tube electrodes (not shown). Electrically conductive member 40 is spot welded to starting resistor 42 and current conductor 44. The other end of resistor 42 is connected to the inlead 46 of a starting electrode (not shown). Except for conductor 44 and inleads 36, 38 and 46 which are made of molybdenum and the actual resistor portion of resistor 42, all of the frame parts herein mentioned are made of a nickel plated steel. The lamp also contains a getter strip 30' coated with a metal alloy material primarily to getter or absorb hydrogen from inside the lamp envelope.

The above is intended to be an illustrative, but non-limiting embodiment of a particular lamp structure useful for metal halide lamps in the practice of this invention. The invention will be further understood by reference to the examples below.

EXAMPLES

Figure 2:
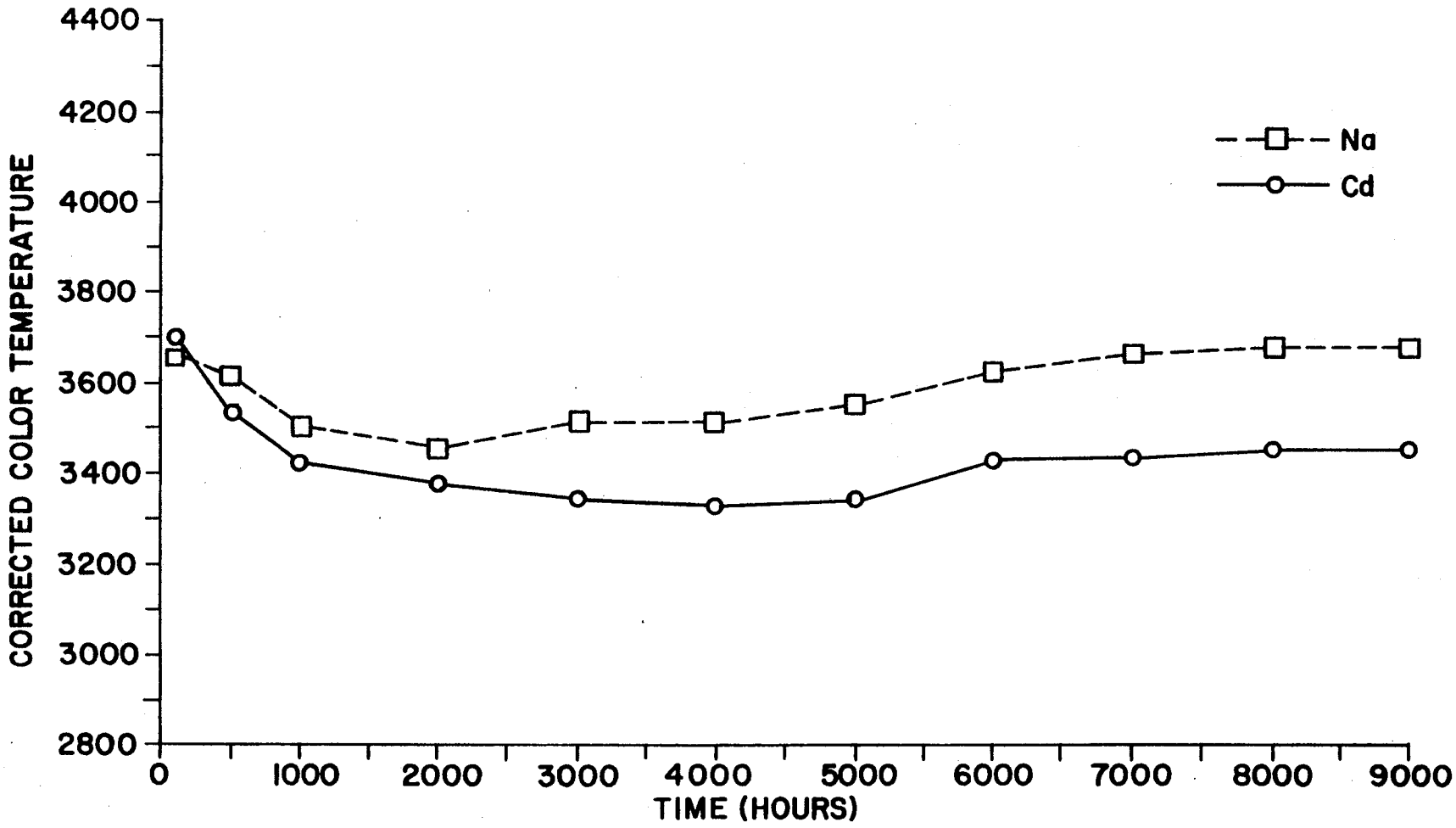
FIG. 2 is a graph illustrating the relative color temperature of a lamp of the present invention containing a sodium getter and of a prior art lamp containing a cadmium getter, as a function of lamp burning time.

In the following examples a number of lamps according to the present invention were made as generally shown in FIG. 1 wherein the dimensions of the arc tube or chamber were 20 mm diameter and 58 mm length hermetically enclosing argon as a starting gas at a room temperature pressure of 25 torr, and 63 mg of an amalgam of sodium metal and mercury metal containing 4 mole % sodium, or 63 mg of an amalgam of cadmium and mercury wherein the amount of cadmium was 3 mole %. The cadmium gettered lamps are commercially available and represent prior art lamps. The spacing between the electrodes was 42.6 mm. The metal halide fill was 42 mg of a sodium iodide, scandium iodide and thorium iodide mixture in a weight ratio of 86/12/2, respectively. The lamps were nominally rated for operation at 400 watts (135 volts and 3.1 amps). Thirty-nine lamps of both types were operated on cycles of 11 hours on and 1 hour off for 10,000 hours. The results showed no significant difference in lumen maintenance or lumen output between the lamps containing the cadmium getter and the lamps of the invention containing the sodium getter over the 10,000 hours. FIG. 2 illustrates the corrected color temperature (CCT) in degrees kelvin of both the sodium gettered lamps of the invention and the cadmium gettered prior art lamps. As the data in the figure show, the sodium gettered lamps of the invention exhibited substantially less drop in color temperature over the 10,000 hour operating time than did the cadmium gettered lamps of the prior art.

What is claimed is:

1. A metal halide arc discharge lamp comprising a light-transmissive arc chamber hermetically sealed and containing within a fill comprising sodium metal, mercury metal, a starting gas and at least one ionizable metal halide, wherein said sodium metal is present in an amount sufficient to getter any excess halogen initially present in said arc chamber and wherein said amount of sodium metal present initially ranges between 1 to 5 mole % of the total amount of said mercury metal and said sodium metal.

2. The lamp of claim 1 wherein said sodium is present to getter said excess halogen initially present in said arc chamber and also impurities initially present which react with said fill to release said halogen during initial operation of said lamp.

3. The lamp of claim 1 containing at least one metal iodide species.

4. The lamp of claim 2 containing at least one metal iodide species.

5. The lamp of claim 4 wherein said ionizable metal halide consists essentially of at least one iodide.

6. A metal halide arc discharge lamp comprising a light-transmissive fused quartz arc chamber hermetically sealed and including within a pair of spaced apart electrodes and a fill comprising sodium metal, mercury metal, a starting gas and at least one ionizable metal halide for forming a light-emitting arc, wherein said sodium metal is present in said arc chamber in an amount sufficient to getter any excess halogen and other impurities initially present in said arc chamber and wherein said amount of sodium metal present initially ranges between 1 to 5 mole % of the total amount of said mercury metal and said sodium metal.

7. The lamp of claim 6 wherein said starting gas consists essentially of at least one noble gas.

8. The lamp of claim 7 wherein said halide is selected from the group consisting essentially of iodides, bromides, chlorides and mixtures thereof and wherein said excess halogen is selected from the group consisting essentially of iodine, bromine, chlorine and mixture thereof.

9. The lamp of claim 8 wherein said noble gas is selected from the group consisting essentially of argon, krypton, xenon and mixtures thereof.

10. The lamp of claim 9 wherein at least one ionizable metal iodide is present.

11. The lamp of claim 10 wherein said metal iodide includes sodium iodide.

* * * * *